United States Patent [19]

Fickelscher

[11] 4,390,328

[45] Jun. 28, 1983

[54] MACHINE WITH ROTARY PISTON INCLUDING A FLEXIBLE ANNULAR MEMBER

[75] Inventor: Kurt G. Fickelscher, Frankenthal, Fed. Rep. of Germany

[73] Assignee: P. A. Rentrop, Hubbert & Wagner Fahrzeugausstattungen GmbH & Co., Stadthagen, Fed. Rep. of Germany

[21] Appl. No.: 127,437

[22] Filed: Mar. 5, 1980

[30] Foreign Application Priority Data

Mar. 9, 1979 [DE] Fed. Rep. of Germany ..... 2909228

[51] Int. Cl.[3] ..... F01C 5/02; F01C 5/06

[52] U.S. Cl. ..... 418/45; 418/153; 418/175; 418/177; 418/251

[58] Field of Search ..... 418/45, 153, 156, 251; 417/476, 477

[56] References Cited

U.S. PATENT DOCUMENTS

| | | | |
|---|---|---|---|
| 1,685,397 | 9/1928 | Carrey | 418/251 |
| 2,451,603 | 10/1948 | Barker | 418/153 |
| 2,519,642 | 8/1950 | Ford | 417/477 |
| 2,885,966 | 5/1959 | Ford | 417/477 |
| 3,166,017 | 1/1965 | Mamo | 418/156 |
| 3,216,362 | 11/1965 | Hewko | 418/45 |
| 3,677,668 | 7/1972 | Rosenberg | 418/45 |

FOREIGN PATENT DOCUMENTS

| | | | |
|---|---|---|---|
| 1255848 | 12/1967 | Fed. Rep. of Germany | 418/153 |
| 2159065 | 6/1973 | Fed. Rep. of Germany | 418/45 |
| 981992 | 1/1951 | France | 418/45 |
| 520016 | 4/1940 | United Kingdom | 418/251 |
| 785597 | 10/1957 | United Kingdom | 418/45 |
| 1031595 | 6/1966 | United Kingdom | 417/477 |

*Primary Examiner*—John J. Vrablik

*Attorney, Agent, or Firm*—Penrose L. Albright

[57] ABSTRACT

A fluid driving or fluid driven machine includes an outer cylinder housing a stationary piston. The piston includes a generally annular flexible band of smaller circumference than the inner circumference of the cylinder, and a rotary body accommodated within the band. The rotary body has three rollers for urging the band against the inner surface of the cylinder at three angularly spaced locations so that the band defines with the cylinder three working chambers. Two separating members mounted on the cylinder are biased into contact with the band.

When the rotary body is rotated the band makes nonslip contact with the wall and rotates the working chambers about the axis of the rotary body. Each separating member separates each working chamber as it passes into two discrete enclosures. A port is located on each side of each separating member to allow communication with the two discrete enclosures. The machine can be operated as a compressor when the rotary body is driven or as an engine to drive the rotary body.

3 Claims, 33 Drawing Figures

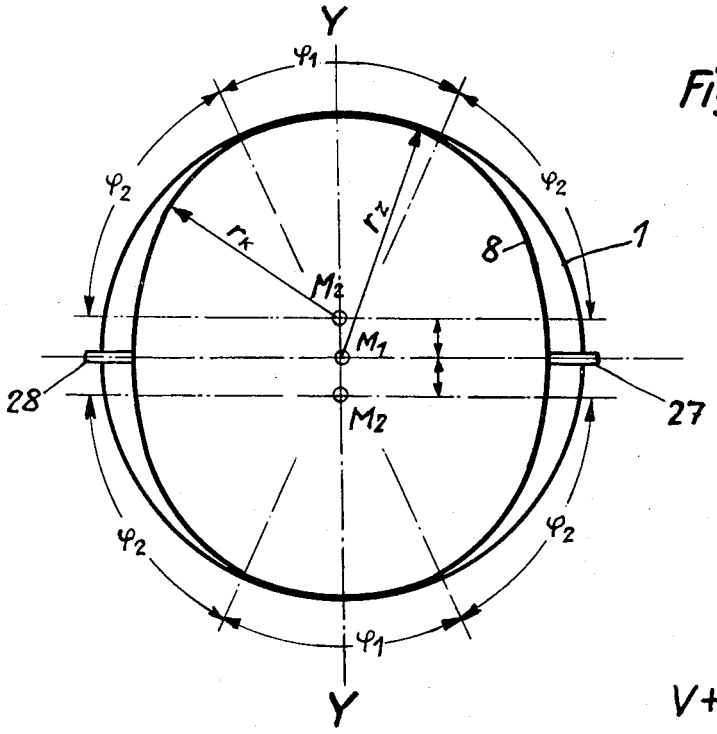
Fig. 5
Fig. 6
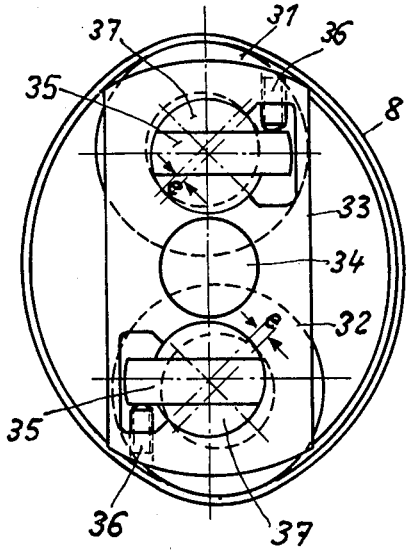
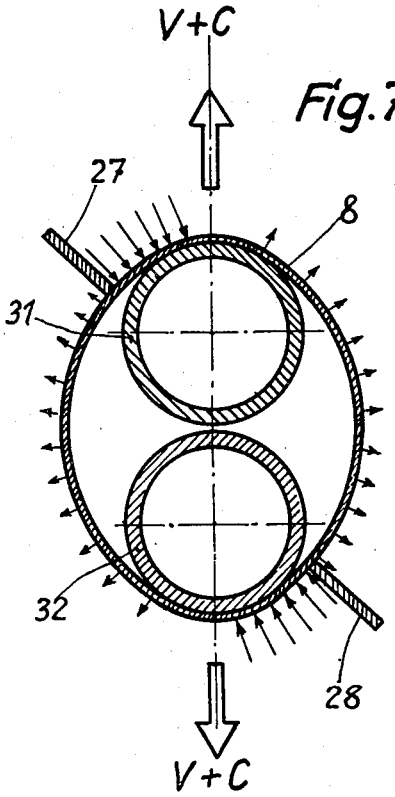
Fig.7

Fig. 8
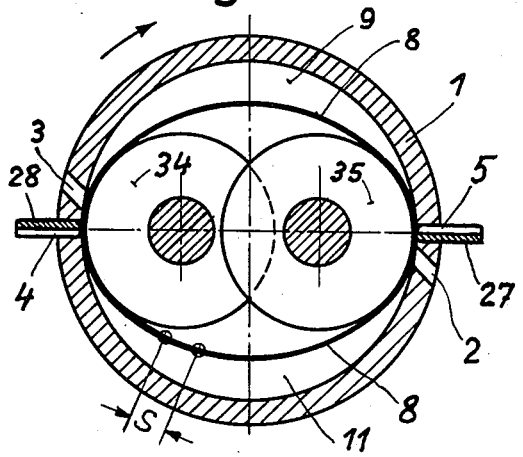
Fig. 9
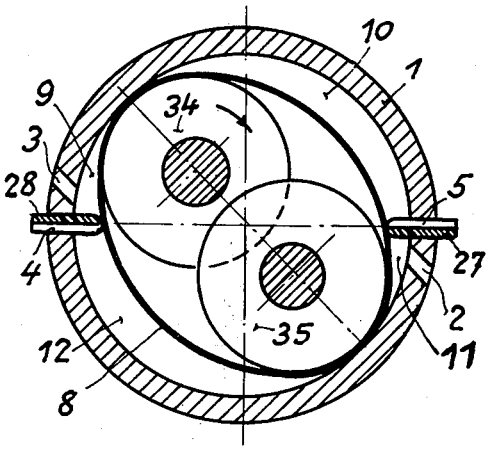
Fig. 10
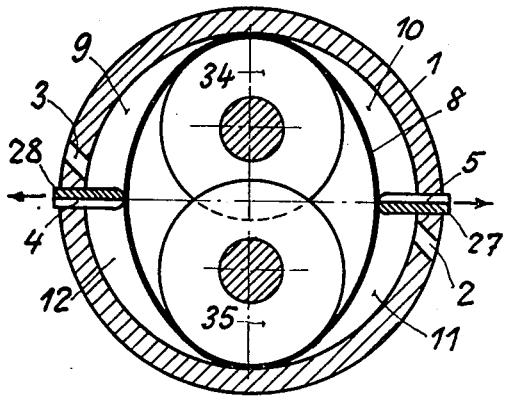
Fig. 11
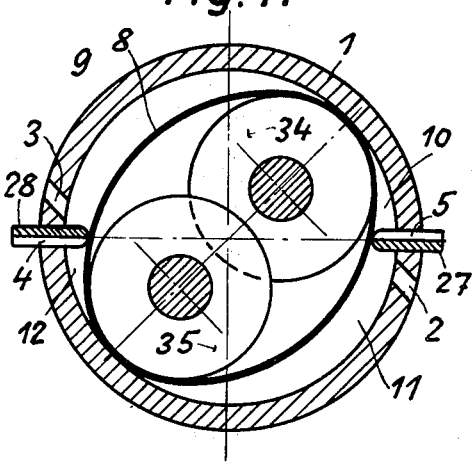
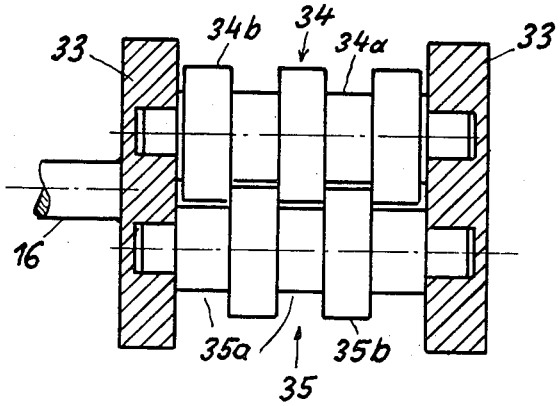
Fig. 12

Fig. 19
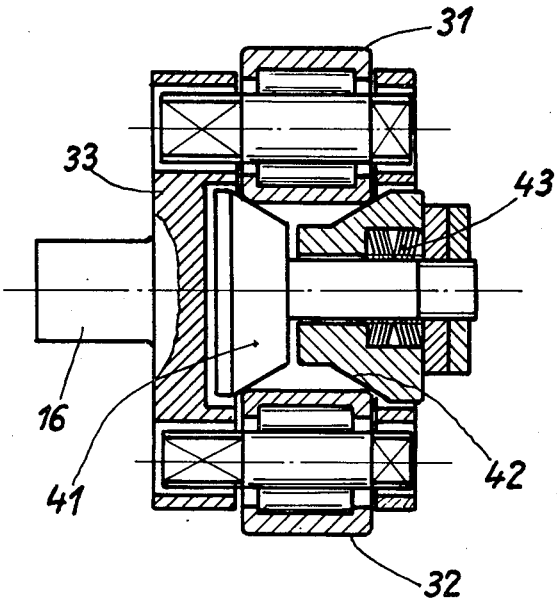
Fig. 21
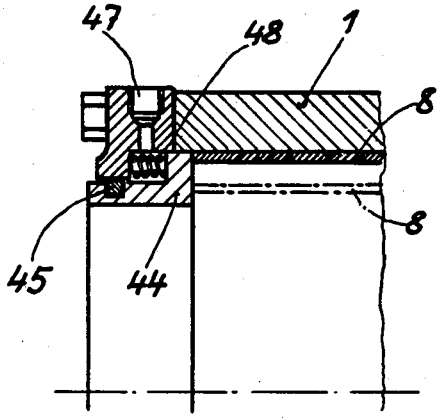
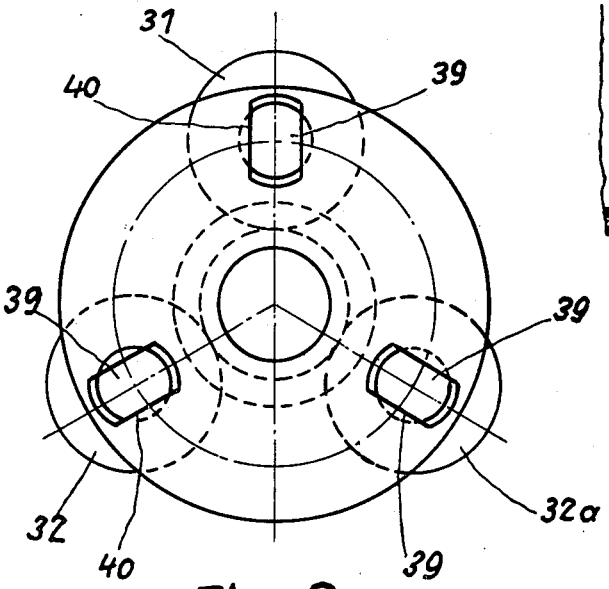
Fig. 20
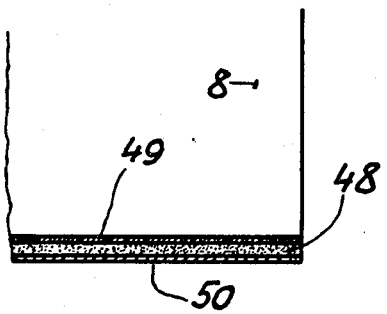
Fig. 22

MACHINE WITH ROTARY PISTON INCLUDING A FLEXIBLE ANNULAR MEMBER

BACKGROUND OF THE INVENTION

1. Field of the Invention

The present invention relates to fluid driven and fluid driving machines, compressors for example.

2. Description of the Prior Art

A previously proposed rotary piston compressor has a circular and rigid piston, of which the diameter may be up to approx. 10% smaller than the cylinder diameter. The piston is pressed against a cylinder wall by an eccentric crank drive. In order to produce a suction and pressure chamber, the cylinder carries a radially movable separating slide which is pressed against the rotary piston by spring pressure. During one rotation, there is an induction stroke and an expulsion stroke.

As long as the piston is pressed against the cylinder wall with sufficient initial tension, the piston will roll by virtue of its smaller diameter and in accordance with the equation:

$$i = \frac{D_K}{D_K - D_2} \text{ for } D_K = XD_2 \qquad (K = \text{piston diameter})$$

$$i = \frac{1}{X - 1} \qquad (Z = \text{cylinder diameter})$$

This means that for 10% smaller diameter, the piston rolls in opposition at 10% smaller diameter at i=(−) 10, in other words one-tenth of the rotary speed of the camshaft, but naturally only as long as the friction moment between cylinder and piston is greater than the bearing friction moment. Therefore, functionally what is involved is a single planet friction wheel transmission with a cam drive. Balancing is by means of counterweights on the crankshaft. There is linear contact at the rolling point and, for adequate pressure, the linear contact flattens out according to the Hertzian equation.

By reason of the reduced rolling speed of the piston, sealing between the separating slide and the piston presents no particular problems. The main problems, particularly when the unit is used as a compressor, arises at the point of contact between piston and cylinder.

Insufficient applied pressure interferes with the rolling process and, due to an increase in the rotary speed of the piston, leads to friction wear and sealing errors. Non-circularity means that the piston becomes incapable of functioning. Excessive applied pressure increases the Hertzian pressure. After a short period of operation, faults occur due to material fatigue. The rolling process becomes kinematically disturbed by the cylinder slot housing the separating slide. The width of the separating slide is greater than the flattening-out caused by the Hertzian pressure so that at this point the piston emerges from the frictional closure. The cross-section to accommodate the separating slide extends over the total width of the piston. The friction moment exerted by the separating slide is naturally smaller than the bearing friction moment. At this point, the piston emerges from its frictional closure. The forces occasioned by compression counteract the force of application.

The object of the invention is to avoid these drawbacks and to enhance the seal between the separating elements on the one hand the piston on the other hand and furthermore to ensure that the wear on the piston is reduced substantially to zero.

SUMMARY OF THE INVENTION

According to the present invention there is provided a machine comprising a rotary piston, a cylinder housing the rotary piston so that the piston defines with the cylinder a working chamber, a separating element mounted on the cylinder to extend from the internal surface of the cylinder into contact with the piston to divide the working chamber into a compression chamber and a suction chamber, the cylinder defining ports arranged to communicate with said suction and pressure chambers, the piston comprising a flexible generally annular member, a rotary body accommodated by the annular member and having at least two portions which urge the annular member against the internal surface of the cylinder with a force such that during rotation of the rotary body movement between the outer face of the annular member and the inner surface of the cylinder is substantially slip-free.

According to the present invention there is further provided a machine comprising two spaced end plates, a member defining a generally cylindrical surface between the end plates, an endless imperforate web of flexible material having a surface facing said cylindrical surface and in sealing engagement with said end walls, rotary means engaging the web and applying the web against the cylindrical surface in at least two positions so that said web defines with the cylindrical surface at least two working chambers, the contacts and thus the working chambers rotating about the rotary axis of the rotary means when the rotary means is rotated but so that no slip occurs between the web and the cylindrical surface, and a plurality of separating elements mounted on the member and biased into engagement with the web whereby when a working chamber passes a said separating element it becomes divided into two discrete chambers, the member defining two ports for each said separating element one upstream of the separating member and one downstream thereof to enable separate communication with said two discrete chambers, when a said working chamber passes the separating member.

BRIEF DESCRIPTION OF THE DRAWINGS

Machines embodying the invention will now be described, by way of example, with reference to the accompanying diagrammatic drawings, in which:

FIG. 5 is a diagram illustrating the rolling conditions of the machine of FIGS. 3 and 4;

FIG. 6 is a fragmentary view of a third one of the machines;

FIG. 7 is a view illustrating the pressure conditions generated in the machine of FIG. 6;

FIGS. 8 to 11 are cross-sections through a fourth one of the machines in different operative states;

FIG. 12 shows, to a reduced scale, a partial section through the machine of FIGS. 8 to 11;

FIG. 19 is a partial section through a tenth one of the machines;

FIG. 20 is a side elevation of the machine of FIG. 19;

FIG. 21 is a fragmentary section through the piston and cylinder of the machine of FIG. 1;

FIG. 22 is a fragmentary section to an enlarged scale through the piston of the machine of FIG. 1;

DESCRIPTION OF THE PREFERRED EMBODIMENTS

The machines to be described can each be used both as a prime mover and as a processing machine. For example each machine can be used as an internal-combustion engine or as a compressor in the form of a pump for fluids of all types.

Figure 1:
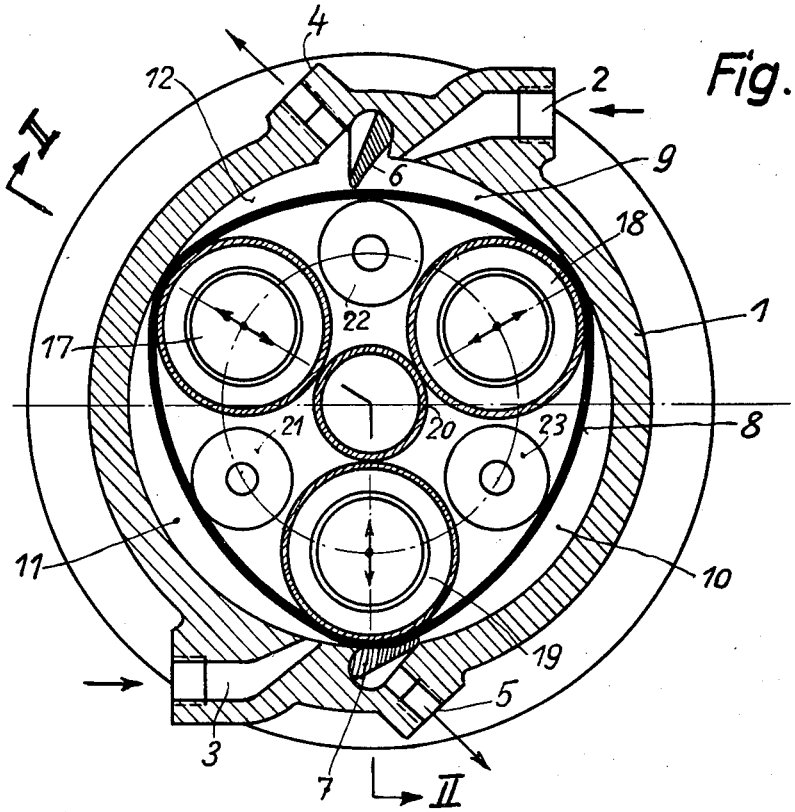
FIG. 1 is a cross-section through a first one of the machines.

As shown in FIG. 1, the machine includes a cylinder having two intake connections 2,3 as well as two outlet connections 4,5. Mounted in the wall of the cylinder 1 are separating elements in the form of pivotal vanes 6,7 which are biassed for example by springs into engagement with a rotary piston 8 located in the cylinder. The piston 8 is in the form of a flexible generally annular member. The separating elements have the same function as the separating slide valves in a conventional rotary piston compressor; that is they separate the suction chambers 9 and 11 and the compression chambers 10 and 12.

The piston 8 encloses a rotary body having three projections which press the piston 8 against the wall of the cylinder 1 at three angularly spaced locations with a force such that during the rotary movement of the rotary body, movement between the outer face of the piston 8 and the inside wall of the cylinder 1 occurs without slip, to provide a slipless rolling action. The pressure necessary for this can be accurately adjusted as will be described in more detail.

The outside diameter of the piston 8 is, when not loaded by the rotary body, smaller than the inside diameter of the cylinder 1.

The rotary body has a cage including two spaced flange-like end plates 13 and 14 rigidly secured together by a plurality of struts or rods 15. The plate 13 carries a drive shaft 16. The three projections of the rotary body are formed by three rollers 17 to 19 (each roller having two roller elements) mounted in the rotary body. Each roller element has a smooth and continuous outer circumferential surface. The axis of rotation of each roller 17 and 19 is radially adjustable. Each roller bears against a freely rotatable central supporting member 20 in the form of a thin-gauge tube having a slightly larger diameter than the smallest circle that can be drawn to make contact with all three rollers. This arrangement is self-centering and requires no additional mounting of the rotary body which in this embodiment is used as a prime mover. In addition, three supporting rollers 21 to 23 are mounted on the cage to limit the extent to which the piston 8 can be displaced radially inwardly. The supporting rollers 21 to 23 will only contact the piston when the piston is subjected to loading.

Figure 2:
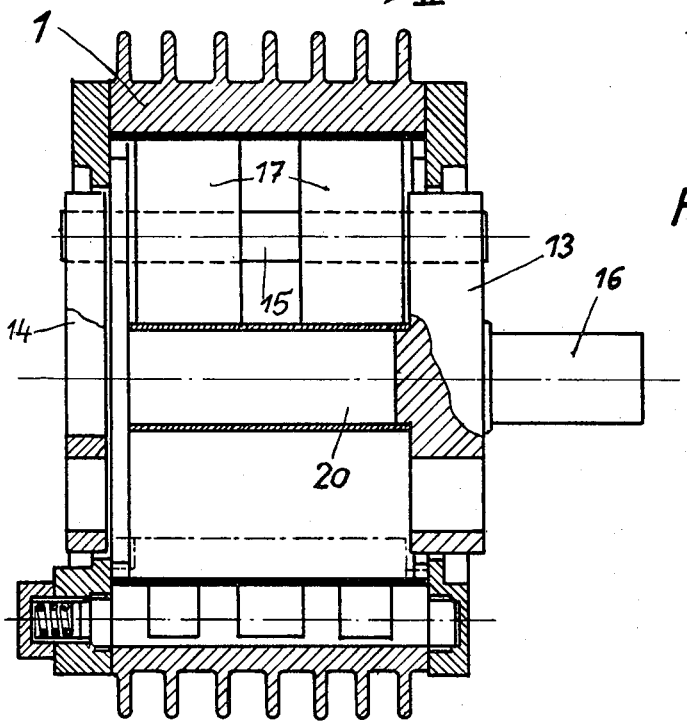
FIG. 2 is a section taken on the line II—II of FIG. 1.
Figure 3:
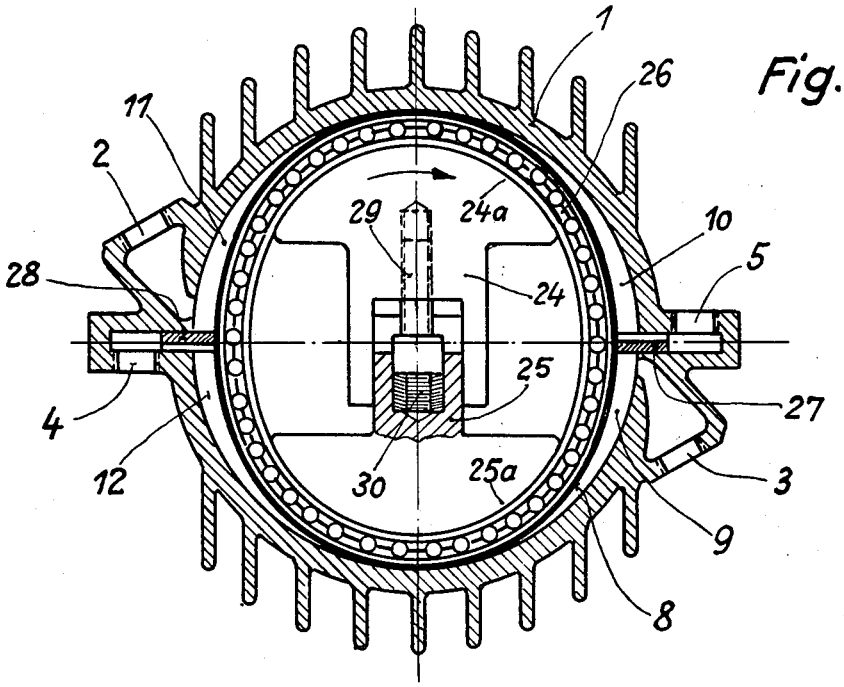
FIG. 3 is a cross-section through a second one of the machines.
Figure 4:
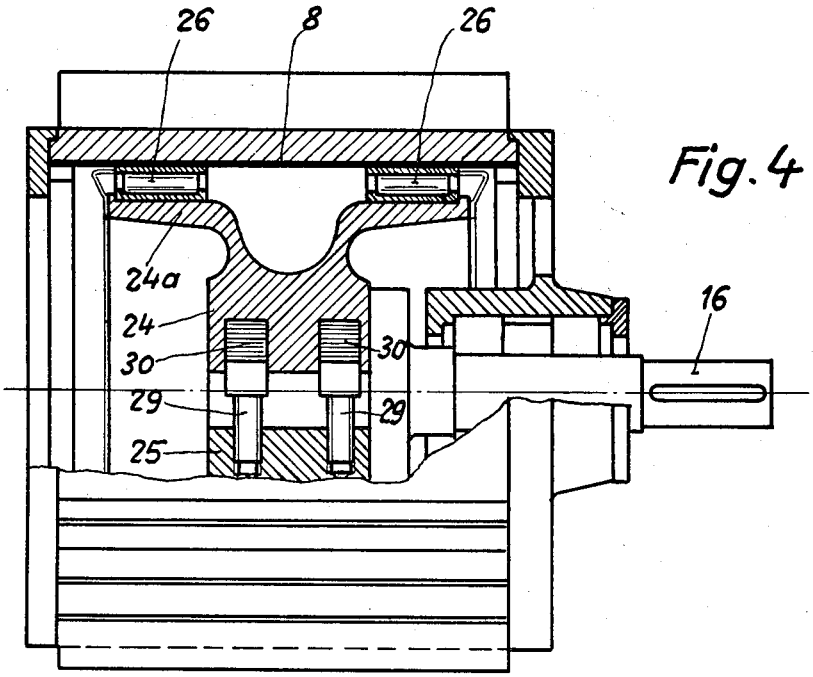
FIG. 4 is a part cut away section of the machine of FIG. 3.

In the machine shown in FIGS. 3 and 4, parts similar to those in FIGS. 1 and 2 are similarly referenced. As shown, the machine has a rotary body built up of two parts 24 and 25. The two parts are biased by a pair of springs 30 away from one another. Each part 24 and 25 carries a pair of arcuate projections 24*a*,25*a*. The arcuate projections 24*a* and 25*a* carry two sets of endless loops of roller bearings 26. The chamber separating elements are in the form of slide valves 27 and 28. The rotary body is initially adjusted to create the appropriate tension in supporting the piston by means of screws 29 to adjust the resilience of the springs 30. It is, however, also possible to use a plurality of roller bearings with end contact. The pressure applied to the piston will be assisted by centrifugal forces when the piston starts to rotate. This machine is particularly suitable for use as an oil pump or oil motor.

FIG. 5 illustrates the rolling conditions of the machine of FIGS. 3 and 4. The arrangement is so contrived that over a given angle $\rho_1$, a flat rolling contact is established between the cylinder 1 and the piston 8. As a result, only a small pressure is required to ensure adequate reliable rolling. Furthermore, the interruptions in the surface of the cylinder 1 accommodating the separating slide valves 27 and 28 is so rolled over that there is no slip, knock or return flow. The flat bearing contact avoids a Hertzian pressure so that the result is a minimal material loading and consequent reduced wear and tear.

The flat bearing contact is achieved because the rotary body is so constructed that in the region subtended by the angle $\rho_1$, the body and the cylinder 1 have a common axis of rotation $M_1$. The compression chambers are created by pressing the piston to reduce its radius from $r_z$ along the y axis to radius $r_k$ at a point intermediate the x- and y- axes. The effect is to displace the center of the piston from $M_1$ to $M_2$ along the y-axis. The transitions from $r_k \rightarrow r_z$ are rounded off. Any other shape of curve can be used between the part of the piston subtended by the angle $\rho_1$ and the x- axis.

In the machine shown in FIG. 6 a piston 8 houses a rotary body having two rollers 31 and 32. These rollers 31 and 32 urge the piston 8 against the wall of the cylinder (not shown). The rollers 31 and 32 are mounted between a pair of spaced plate-like supports 33 one of which carries shaft 34. The rotary body thus includes a cage. Each roller 31 and 32 is rotatable about a respective pivot pin 37 mounted for rotation eccentrically on a corresponding support 33. Each pin 37 carries a lever 35 which can be adjusted by means of a screw 36 screw-threadedly engaging the support 33. By varying the degree of eccentricity e, the pressure with which the piston 8 can be urged against the cylinder 1 is varied. This pressure can instead be provided by means of springs or by a pressurized medium.

FIG. 7 illustrates the pressures applied to the piston of the machine shown in FIG. 6. The large hollow arrows are indicative of the force produced on the piston by the rollers 31 and 32. The remaining arrows illustrate the resulting mechanical and dynamic forces. Due to the suction process, a reduction in force level occurs which generates outwardly directed forces of minor magnitude (small arrows).

As a result of compression, inwardly-directed forces occur (large arrows) which are substantially greater than the suction forces. Since, however, the compression zone—in relation to the periphery—is relatively small and dependent upon the compression ratio, these forces act substantially on the rollers 31,32.

The pressures applied to the piston by the rollers 31 and 32 are assisted by centrifugal forces if the rollers 31 and 32 are permitted some radial displacement. The forces arising out of the roller tension V and the centrifugal force C must always be greater than and in opposition to the resulting gas forces in the working chambers. It will be appreciated that the forces are opposite one another and are directed towards a common axis of rotation. Where the delivery of liquids is concerned, the loading of the piston 8 is greater due to the incompressibility of the liquid so that additional supporting rollers should then be provided to counteract flexure of the flexible piston 8.

In the machine shown in FIG. 12 two rollers 34 and 35 are supported between two end plates 33. The roller 34 has a plurality of annular slots 34*a* defining roller elements 34*b*. The roller 35 also has a plurality of annular slots 35*a* defining roller elements 35*b*. The two rollers 34 and 35 are arranged in meshing engagement so that each element 34*b* mates with a corresponding slot 35*a* and each element 35*b* mates with a corresponding slot 34*a*.

FIGS. 8 to 11 show the machine of FIG. 12 in various operative positions.

In the position shown in FIG. 8, the suction process is completed. The two suction chambers 9,11 which are bounded by the inside wall of the cylinder 1 and the piston 8 of flexible material have their greatest volume in this position. The two suction connections 2,3 are closed by the piston 8 and the two separating slide valves 27,28 are both in their top dead center positions.

After the rotary body has travelled through about 45° in a clockwise sense, the position shown in FIG. 9 is reached. The medium in the two chambers is forced out through the outlet connections 4 and 5. By corresponding adjustment of the force of applied pressure, the piston 8 completes a perfect rolling movement along the inside wall of the cylinder 1, so that no slip occurs.

After further movement of the rotary body through an angle of about 45°, the suction chambers 9 and 11 and the pressure chambers 10 and 12 are only half filled (FIG. 10).

Upon a rotation through another 45° (FIG. 11), the induction process and the delivery process are virtually completed. The piston has thereby moved by the amounts in an counterclockwise sense in relation to the rotary moveemtn of the rotary body in a clockwise sense.

Figure 13:
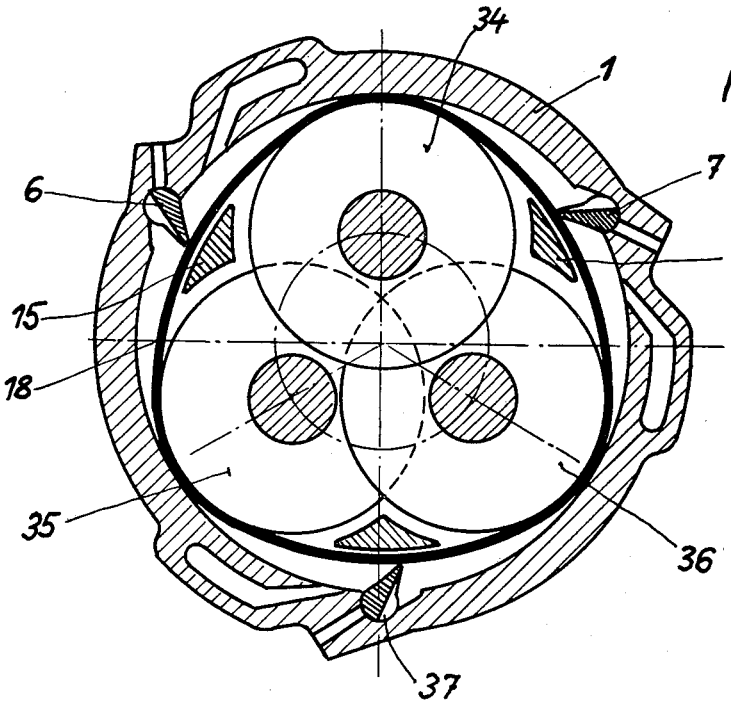
FIG. 13 is a cross-section through a fifth one of the machines.

In the machine shown in FIG. 13, three rollers 34 to 36 are supported between a pair of end plates (not shown). Each roller is provided with annular slots defining roller elements. The three rollers mesh together in a similar manner to that shown in FIG. 12. Furthermore, three pivotal vanes 6, 7 and 37 are provided as separating elements.

Figure 14:
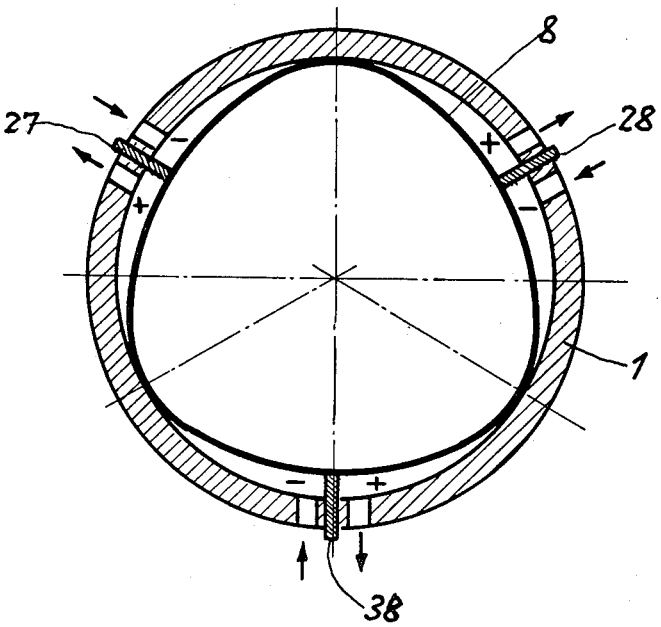
FIG. 14 is a diagram of a sixth one illustrating the mode of operation of the machine of FIG. 13.

The mode of operation of the machine of FIG. 13 is illustrated in FIG. 14 in which the separating elements are illustrated as separating slide vanes 27, 28 and 38. For the sake of clarity, the rollers 34 to 36 have been omitted. The machine has three suction chambers and three pressure chambers. The arrows adjacent each opening in the cylinder indicate the direction of flow of the medium through that opening. During one complete revolution, the number of working strokes is nine, so that the volumetric degree of utilization is substantially increased. During induction and ejection of the medium, there are, however, zero phases.

Figure 15:
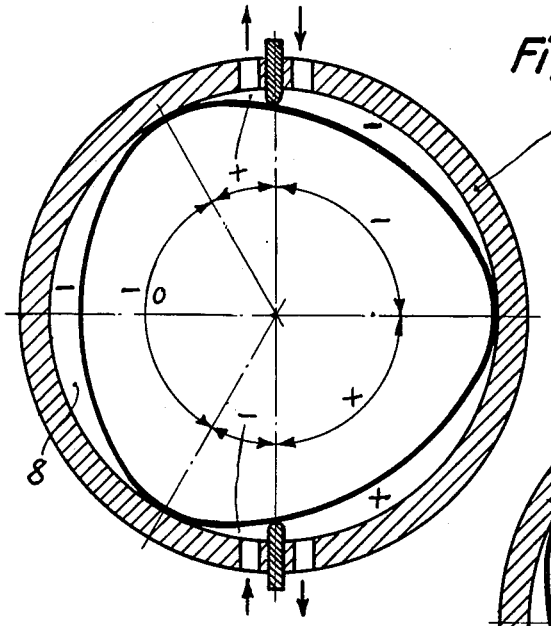
FIGS. 15 to 17 are diagrammatic representations of an eighth one of the machines in different operative states.
Figure 16:
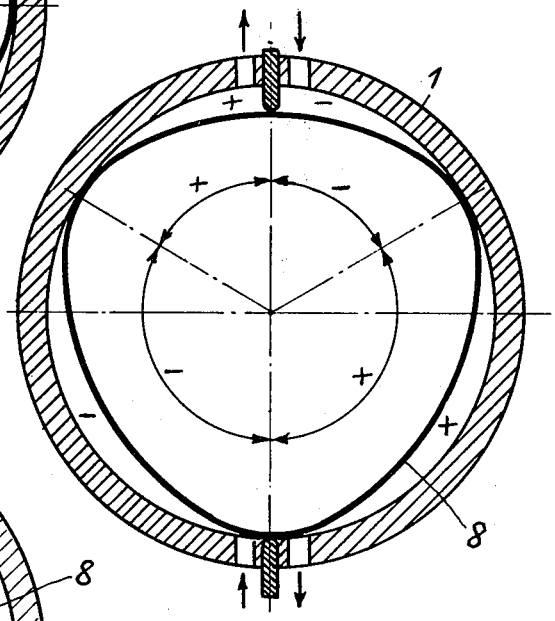
Figure 17:
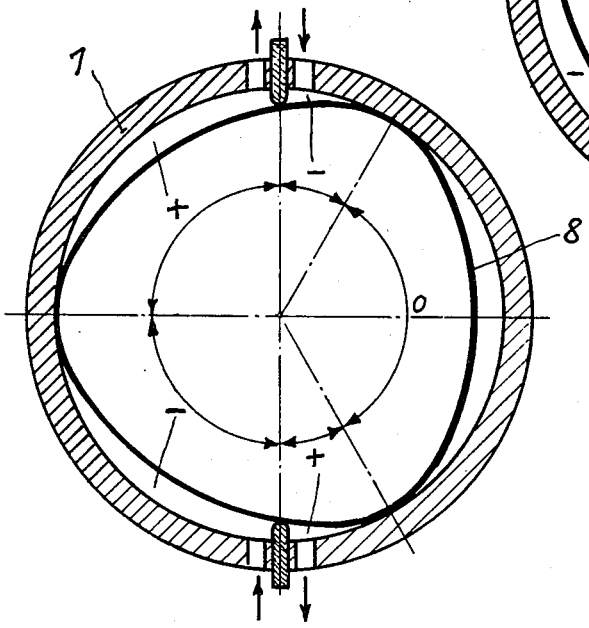

FIGS. 15 to 17 illustrate the mode of operation of the machine of FIG. 1 in which the separating elements in the form of pivotal vanes are however replaced by separating slide valves. This machine is particularly suitable for regularizing the induction and discharge stroke. For the sake of clarity, the rollers 17 to 19 have been omitted. During each revolution, four working strokes take place, the arrows over the inlet apertures and discharge orifices indicate the direction of flow.

Figure 18:
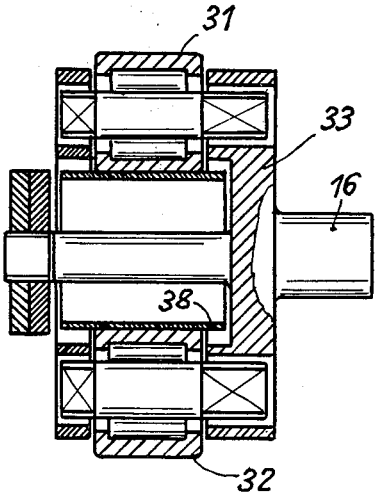
FIG. 18 is a partial section through a ninth one of the machines.

FIG. 18 shows a partial section through a machine similar to the machine of FIG. 6. The pressure of application is generated by a thin-walled supporting roller 38. This design can be manufactured at low cost and operates with low wear. In a modification the central supporting roller 38 is serrated and acts to drive rollers 31 and 32 which are likewise serrated.

The machine shown in FIGS. 19 and 20 includes three rollers 31, 32 and 32*a* equiangularly spaced about a central axis. Each roller is mounted on needle bearings for radial displacement in a respective longitudinally extending slot 39 in a support 33. The slots 39 have faces 40 ensuring rigidity against rotation. A pair of longitudinally displaceable tapered rollers 41 and 42, located on opposite sides of the array of three rollers are movable towards one another along the central axis to engage the three rollers 31, 32 and 32*a* to displace the rollers radially outwardly, the displacement being assisted by the centrifugal forces which arise when the assembly is rotated. A spring 43 biases the two tapered rollers 41 and 42 towards one another.

FIG. 21 shows a partial view of an end seal of each of the machines of FIGS. 1 to 20. The cylinder 1 carries a flange at each axial end. Each flange accommodates a slip ring 44. Each slip ring 44 has an annular groove carrying an O-ring 45 providing a seal between the slip ring and its corresponding flange. In its top and bottom dead center positions, the piston 8 bears on the end face of the slip ring 44. The stepwise constructed slip ring 44 is applied in pressure dependent fashion in accordance with its differential surface. Each slip ring 44 is urged into contact with the piston by a plurality of springs 46. Arresting media can be supplied through bores 47 in each flange into the space between the flange and the slip ring to increase the contact pressure between the slip ring and the piston.

FIG. 22 is a partial section through the piston 8 of each of the machines of FIGS. 1 to 20. As shown the piston 8 is built up of three layers 48 to 50, the outer layer 50 is of a material having a high coefficient of friction, the middle layer 58 is of a material having a low coefficient of friction, and the inner layer 49 is of a wear resistant material.

Figure 23:
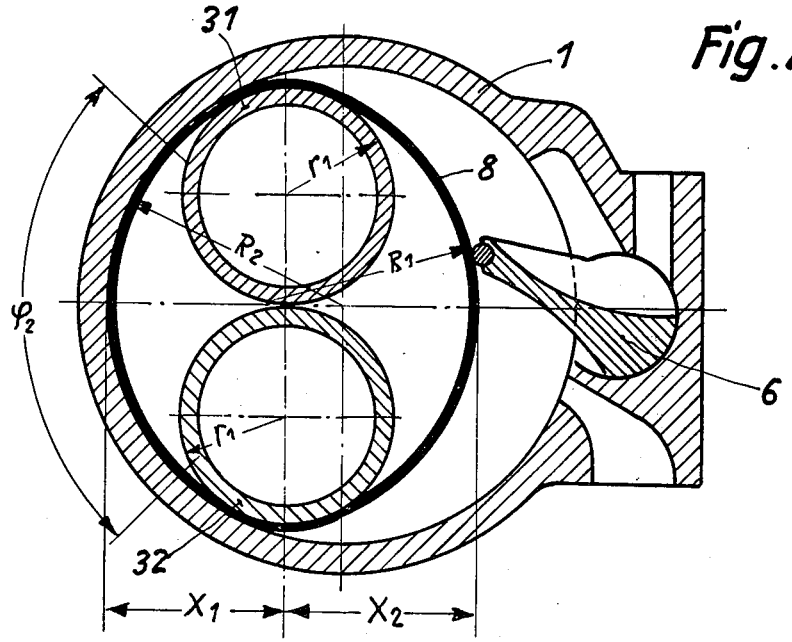
FIG. 23 is a cross-section through an eleventh one of the machines.

The machine shown in FIG. 23 has a piston 8 with its central axis spaced from the central axis of the cylinder 1. As a result of the large area of contact between the piston and cylinder the diameter of the piston 8 when in its relaxed state can be 20% and more smaller than the internal diameter of the cylinder 1. In consequence, after the piston has been shaped into the form of an ellipse, a fairly large working space is created. This working space is divided into a suction chamber and a pressure chamber by a separating element in the form of a pivotal vane 6 or a separating slide valve. The piston 8 is of elliptical form and so chosen that the curve $R_1$ which connects the crown circles $r_1$ is more sharply curved than the inside radius of the cylinder 1. Conventional crank drives or piston guidance transmissions (not shown) urge the piston 8 against the inside wall of the cylinder 1 in such a way that it is flattened off on one side and has an area of contact subtending an angle $\rho_2$ of the cylinder 1. The ellipse formed by the piston is asymmetrical $X_1 < X_2$; where $X_1$ is the maximum distance of the piston on one side of the axis passing through the centers of the two rollers, from that axis, and $X_2$ is the maximum distance of the piston on the other side of the axis from the axis. The necessary friction moment between the cylinder 1 on the one hand and the piston 8 on the other hand is brought about by the resilience of the piston 8. This machine is advantageously employed for effecting considerable volume flows having a low pressure ratio.

Figure 24:
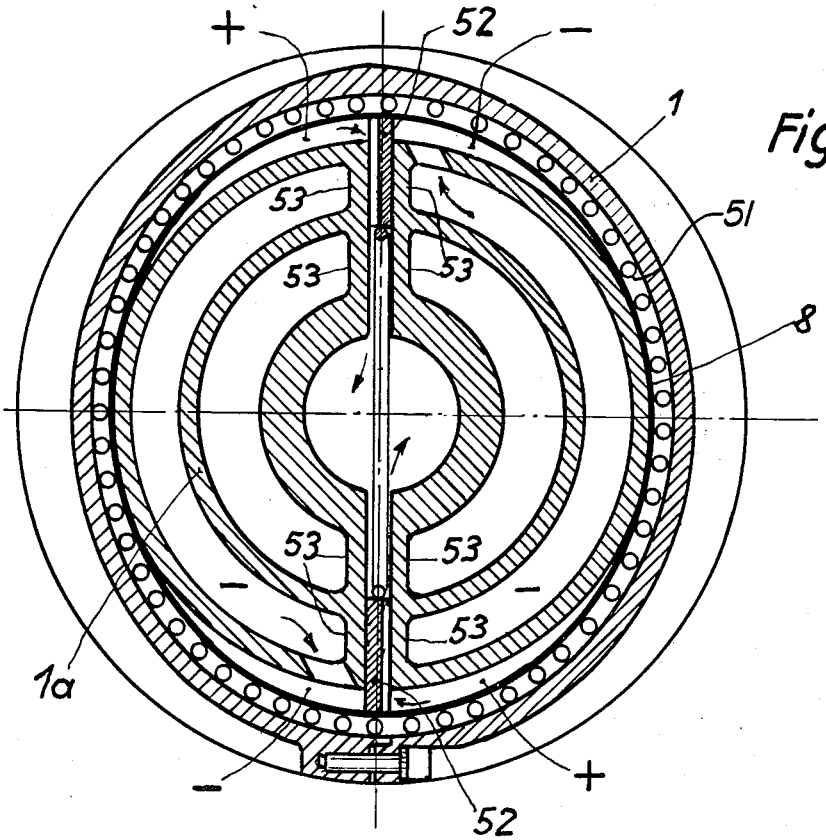
FIG. 24 is a cross-section through a twelfth one of the machines.

The machine shown in FIG. 24 has an internal stationary piston 1*a* surrounded by an outer piston 8 of an elastically deformable material. Rollers 51 are located between the piston 8 and a rotary cylinder 1. The inner circumferential surface of the rotary cylinder 1 is profiled to cause the deformable outer piston 8 to form with the piston 1*a* two working chambers which move around the piston 1*a* as the cylinder 1 revolves. Each working chamber is divided by a respective separating slide valve 52 biased into engagement with the piston 8 by a simple annular spring which is so engaged in them that the slide valves can be held fast (idling control) by the annular spring being tightened in an axial direction. In a modification the slide valves can be replaced by pivotal vanes. The suction chambers are again identified by −, and the pressure chambers by +. Suction and pressure chambers are connected to one another by webs 53 so reducing any heating-up requirement on the suction side.

For readjustment, the cylinder 1 is provided with an axially extending slot, opposite sides of the slot being biased apart by springs but held together by adjusting screws.

Figure 25:
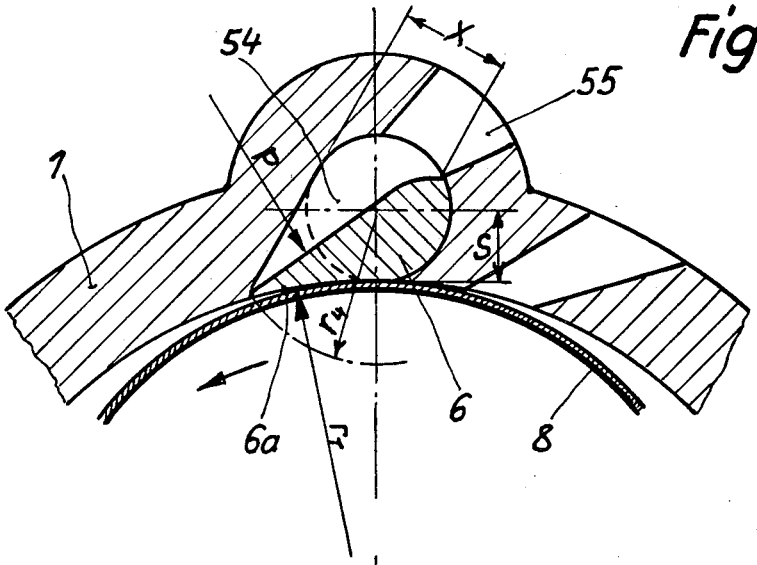
FIGS. 25 to 33 show to an enlarged scale partial sections through various separating elements for use in the machines of FIGS. 1 to 24.
Figure 26:
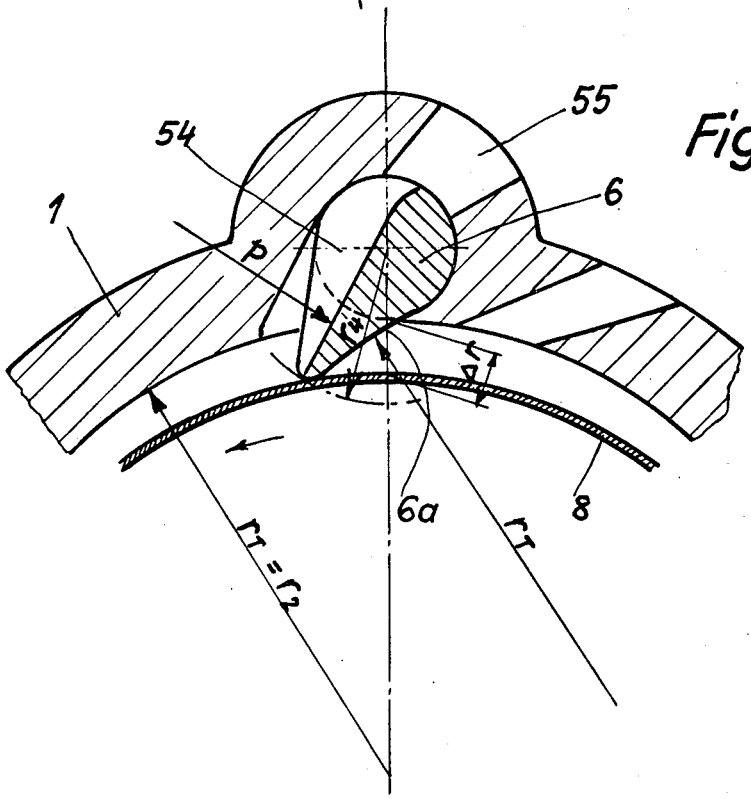

FIGS. 25 and 26 illustrate the pivotal vane of the machine of FIG. 1 in more detail. As shown the vane 6 is of wedge-shaped cross-section and is pivotally supported at its thicker end portion for pivotal movement about an axis. Assisted by the delivery pressure p (arrows) (and possibly by a spring or other force) the vane 6 is urged against the piston 8. The distance $r_4$ of the thin end of the wedge-shaped vane 6 from its axis of rotation is at least 10% greater than $\Delta r + s$; where $\Delta r$ is greatest gap between the piston 8 and cylinder 1 and s is the distance of the vane axis from the inner surface of the cylinder. As a result $r_4$ cannot under any circumstances be pivoted into a position in which it extends at right-angles to the piston 8. Preferably the side of the vane 6 closest to the piston has a radius of curvature rT equal to the radius $r_2$ of the inner surface of the cylinder 1. Then, optimum rolling conditions obtain, since surface contact is not disturbed by the vane 6 when it is in its top dead center position.

The vane 6 is housed in a pocket 54 and by the location of the control edge X in relation to the outlet slot 55, it is possible to control the pressure of compression. With the swinging vane being wedge-shaped, then in the top dead center position a complete seal is achieved in respect of the pressure side. As a result of the low sliding speed, this system operates with minimal wear, namely when the lateral cylindrical journals are located in self-lubricating bearings in the lateral closure.

Figure 27:
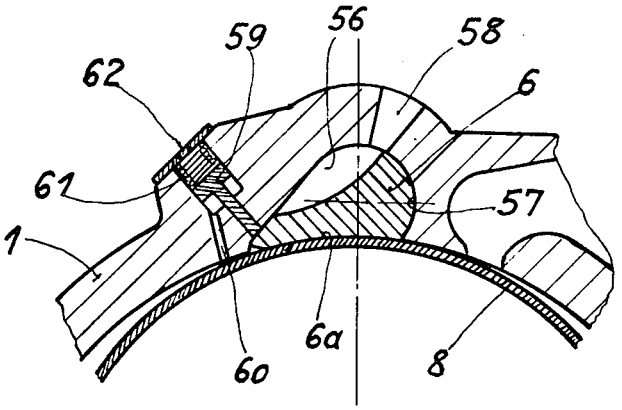
Figure 28:
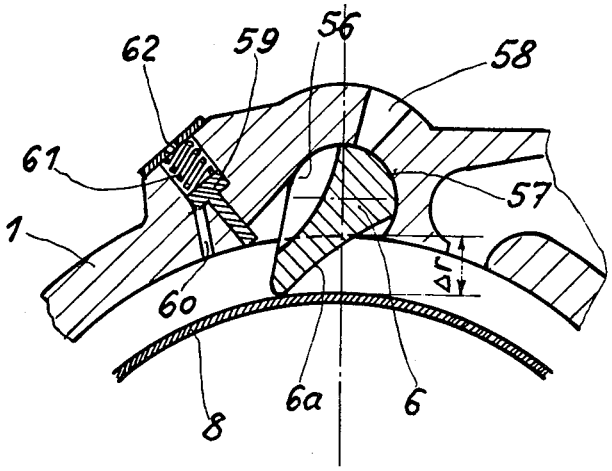

FIGS. 27 and 28 illustrate a modified pivotal vane for the machine of FIG. 1 which is particularly advantageous when the machine is used as a compressor, FIG. 27 shows the extreme position of the vane after the completion of a compression cycle and FIG. 28 shows the extreme position of the vane when there is a maximum distance $\Delta r$ between the piston 8 and the cylinder 1. The vane 6 is provided with slots 56 and has a control surface 57 adapted to the desired compression ratio and which runs over the outlet orifice or port 58 in order to prevent flowback into the suction chamber which would in fact result in additional losses at higher compression ratios. The cylinder 1 also houses a follow-up slide valve 59 which during movement of the vane 6 into the open position, rests on the nose thereof until such time as the outlet orifice 58 is closed by the control surface 57 and until flowback is limited to minimal leakage. During compression, the follow-up slide valve 59 is displaced by pressure communicating with the valve through a channel 60 sufficiently to reduce any unnecessary throttle losses occurring between the vane 6 on the one hand and the cylinder 1 on the other hand.

After the top dead center position has been rolled over, the pressure falls to a suction level. The low volume of control air expands through the channels 60. By pressure of a spring 61, the follow-up slide valve 59 is again urged against the nose of vane 6 until such time as the displacement of follow-up slide valve 59 is limited. The air behind the follow-up slide valve 59 can escape through a bore 62 in the cylinder. Because both the vane 6 and the follow-up slide valve 59 have a small travel, wear is also small. Since it is possible to achieve a large outlet area opposite the valve arrangement and since moreover no pressure increase against a compression pressure is needed to open the valve, this form of control ensures greater efficiency and smoothness. The follow-up slide valve 59 can also be actuated by other means, electromagnetically or through a closed bellows assembly, for example.

Figure 29:
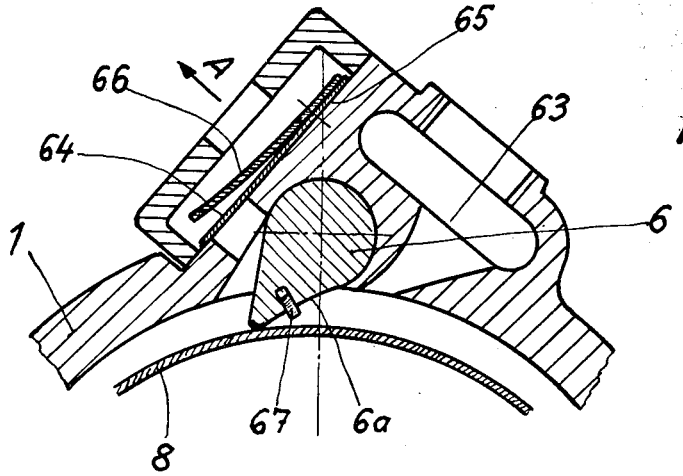

FIG. 29 shows another form of separating valve assembly for use in any of the described machines. The cylinder wall has an interrupted inlet slot 63 and an outlet A closed by leaf springs 64, the travel of which is limited by profiled fingers. An external seal is provided by a hood-like covering 66. Since no inlet valves are needed, the entire axial width of the pressure cylinder can be utilized for the valve arrangement, so that the valve loading can be kept low. Together with the, in most cases, oil-free compression, long valve life can be achieved. In order to improve the seal, the pivotal vane 6 is equipped with a built-in sealing strip 67.

Figure 30:
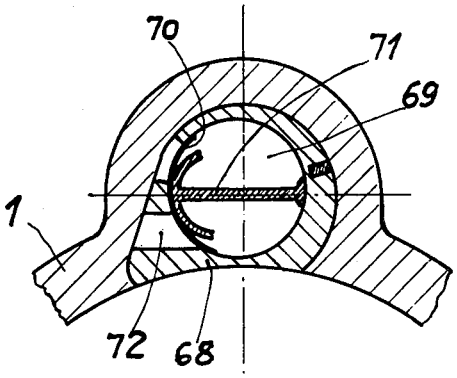

The separating vane assembly shown in FIG. 30 has a hollow pivotal vane 68 provided with a central bore 69. The bore 69 accommodates a cylindrical leaf spring 70 and a travel limiter 71 which at the same time serves as a stepping arrangement. In operation compressed air is admitted through the aperture 72 and passes along the axis, emerging on one or on both sides.

Figure 31:
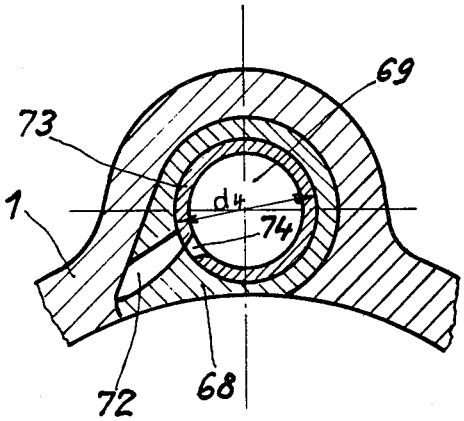

The separating valve assembly shown in FIG. 31 has a hollow pivotal vane 68 provided with a central bore 69 accommodating a control bush 73 having at least one control slot 74. This assembly is particularly suitable for use in machines acting as oil lubricated compressors. Furthermore, this particular assembly enables the injection of coolant or lubricant for the direct cooling of the gas.

By means of a follow-up control located outside of the compression chamber, it is possible in accordance with the desired compression ratio to move the pivotal vane 68 and the control bush 73 at the same angular velocity. By varying this velocity of the control bush 73, the control slot 74 can be opened and closed as the phase shift varies.

The bore diameter $d_4$ of the pivotal vane 68 is somewhat larger than the outside diameter of the control bush 73 housed in the vane 68. Where the diameter $d_4$ is relatively large, sealing strips are added to reduce leakage losses to a minimum. This assembly is also particularly advantageous for incorporation into power generating machines. The end faces of the control bush 73 are masked, the inside diameter chosen according to the sealing ratio and at the same time combustion chamber. Through discharge slots, the gas expands in the expansion chamber which is created after the top dead center position has been passed. Here it is possible easily to recognise the conformance of the radius of the cylinder to that of the pivotal vane.

Figure 32:
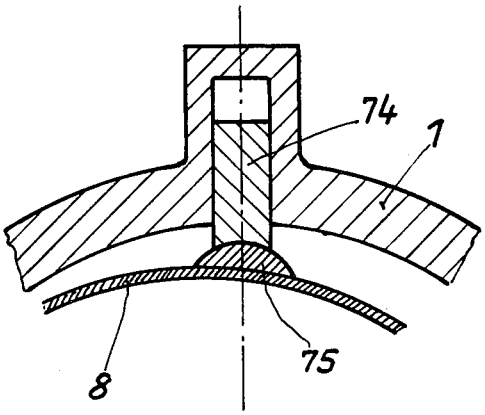

The valve assembly shown in FIG. 32 has a separating slide valve 74 for use in machines operating at high pressures. For this purpose, the separating slide valve 74 is constructed in two parts and is provided with a convex—concave curved sealing strip 75 which has one face arranged to lie flat against the piston 8 and can pivot relative to the other part of the separating slide valve 74.

Figure 33:
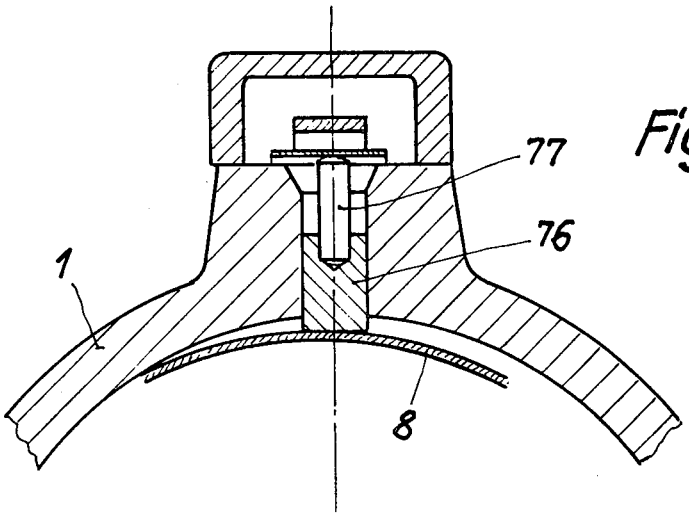

The valve assembly shown in FIG. 33 provides a positive control. At high rotary speeds, fluid medium controlled valves often fail since their natural frequency is below the piston frequency. Increasing the spring stiffness will result in a considerable loss of efficiency insofar as then the cylinder pressure needed to open the valves must rise considerably above the counterpressure.

To avoid this a valve push rod 77 is secured to the separating slide valve 76 by means of the valve and can be lifted at the desired point in time. In consequence, the natural frequency of the valve can be substantially above the piston frequency.

The described machines were found to have the following advantages; functional reliability by virtue of predetermined pressure of application against the contact point between cylinder and piston; no slip between piston and cylinder by reason of automatically predetermined readjustment force; thermally occasioned deformations and deviations from the cylindrical form are automatically compensated; all elements are rotationally symmetrically disposed, so that there are no free forces of inertia; the forces produced by gas or fluid pressures are mutually cancelling, so that in most cases no auxiliary bearings are required for shaft guidance. The system is self-centering; inlet valves, delivery valves act in the low pressure range and can handle both incompressible media and fluids; extremely good heat dissipation, since also the inside of the piston can be cooled; a high degree of volumetric utilization, at least four inlet and delivery strokes during each revolution (two roll drive can be achieved); low speeds at the seals; minimal radial movement of the separating elements; low overall volume; low manufacturing costs; wide range of applications; high driving speeds; low pulsation delivery; good end sealing since by virtue of cylinder and piston cooling there are hardly any length differences to influence the end gap; low noise and vibration; a bulging-out effect automatically readjusts for the opposite resulting compressive forces, the effect of centrifugal force from the planet rolls in the case of a radially movable arrangement; availability for use as an internal combustion engine; suitability for low pressure and high pressure ranges; simple initially circular structural elements; a high degree of efficiency.

Many modifications can be made to the invention without departing from the spirit and scope of the invention as defined by the appended claims.

I claim:

1. In a fluid-flow machine means defining a cylinder having an internal cylidrical surface and ports in that surface respectively for the admission and exhaust of fluid, an assembly mounted within the cylinder including two opposed, interconnected, parts, together rotatable relatively to the cylinder, each part having a peripheral surface with complementary curvature to that of the internal cylindrical surface of the cylinder and having the same centre as that of the cylinder, means biasing the said parts towards the cylinder wall, and a flexible ring interposed between the opposed parts and the said internal cylindrical surface and being pressed against said surface by the parts so that rotation of the parts causes non-slip relative motion between the ring and said surface, working space for the fluid being defined between the ring and said surface, and means mounted on the cylinder dividing the working space into a fluid suction chamber and a fluid compression chamber, the peripheral surface of each said part of the assembly being such that as the ring moves into contact with the portion of the internal peripheral surface of the cylinder defining the ports, surface to surface contact is maintained.

2. A machine according to claim 1 wherein said biasing means comprises spring means interconnecting said parts of the assembly whereby to bias the peripheral surfaces of the parts towards the internal cylindrical surface of the cylinder.

3. A machine according to claim 1, wherein the divider means comprise slide valves mounted in the exhaust ports.

* * * * *